US006144802A

United States Patent [19]

Kim

[11] Patent Number: 6,144,802

[45] Date of Patent: Nov. 7, 2000

[54] FLUID HEATER FOR SEMICONDUCTOR DEVICE

[75] Inventor: Chang Jae Kim, Seoul, Rep. of Korea

[73] Assignee: Hyundai Electronics Industries Co., Ltd., Kyoungki-Do, Rep. of Korea

[21] Appl. No.: 09/342,146

[22] Filed: Jun. 29, 1999

[51] Int. Cl.[7] ..... F24H 1/10

[52] U.S. Cl. ..... 392/479; 392/485; 392/492; 392/493

[58] Field of Search ..... 392/465–7, 478, 392/479, 480, 481, 482–487, 491, 492, 493; 219/544

[56] References Cited

U.S. PATENT DOCUMENTS

| | | | |
|---|---|---|---|
| 1,519,395 | 12/1924 | Clench | 392/493 |
| 1,767,122 | 6/1930 | Dean | 392/492 |
| 3,560,710 | 2/1971 | Fuellemann | 392/476 |
| 5,445,699 | 8/1995 | Kamikawa et al. . | |
| 5,595,606 | 1/1997 | Fujikawa et al. . | |
| 5,930,458 | 7/1999 | Yane et al. | 392/482 |

*Primary Examiner*—Teresa Walberg
*Assistant Examiner*—Thor Campbell

[57] ABSTRACT

A fluid heater for a semiconductor device is provided to uniformly heat a gas, for thereby improving uniformity and speed of gas reaction and thus increasing the yield of semiconductor device fabrication. The fluid heater includes a main heater of a helical shape formed of a thermal conductor having various radii; a transparent tube, in which the main heater is located, having a plurality of holes at a lower portion thereof; an internal vessel disposed at an outer side of the transparent tube and having a plurality of holes at an upper portion thereof; an external vessel located at an outer side of the internal vessel; flanges placed on the external vessel, the internal vessel and the transparent tube and connecting a fluid inflow tube and the transparent tube and an external heater disposed at an outer wall of the external vessel. Here, the main heater is fabricated in a helical shape which has various radii, so that the fluid is evenly heated by a vortex generated by which the fluid passes through the main heater and also the fluid is heated by direct contact with the heater, thereby having an effect of increasing a temperature of the fluid up to a sufficiently high temperature, for example, a temperature above 600° C.

11 Claims, 8 Drawing Sheets

FLUID HEATER FOR SEMICONDUCTOR DEVICE

BACKGROUND OF THE INVENTION

1. Field of the Invention

The present invention relates to an apparatus for fabricating a semiconductor device, and more particularly to an apparatus for heating gases for a semiconductor device that heats gases, which are introduced to a thin film forming device, an oxidation device, an etching device or a reaction furnace, to a fluid state.

2. Description of the Conventional Art

In a semiconductor device such as a thin film forming device or an etching device for fabricating a semiconductor device, a main gas which is a process source (a fluid substance participant of reaction on a wafer) and subsidiary gases such as a carry gas which carries the process source to a reaction furnace and an oxygen gas are introduced into a vaporizer (not shown), respectively maintaining a temperature under 100°, mixed and vaporized therein, then injected as the gaseous state into a chamber through a gas injector 1, and activated by receiving a heat energy or other energy on a wafer W, thereby having a reaction. Numerals 2 and 3 in FIG. 1 are a heat supplying unit and a gas discharge line, respectively.

When forming a thin film using the thin film forming device shown in FIG. 1, it is desirable to maintain a temperature of the wafer to be low and to increase a deposition rate of the thin film. To satisfy such requirements, support in various ways is necessary in the aspect of a hardware of a semiconductor device, and one of the various ways therefor is to introduce a gas in a heated state into the reaction furnace.

When the process sources, the main gases of the reaction, are required to be heated, there is provided a method of heating a process source tank, in which the process sources are stored, and also introducing the process gases, which are in a heated state at a temperature of about 100° C. or below, into the reaction furnace by winding a heater at an outer wall of a tube which is a transfer path of the process source. Among various types of conventional methods of heating a tube, following three types are the most typical methods thereof.

A first type employs a method of heating a gas tube by simply winding a heater at an outer wall of a tube up to 300° C.

As shown in FIGS. 2A and 2B, a second type of the tube heating method is to supply the heat energy to a fluid substance with a small space, wherein the fluid substance is heated while flowing in a tube 20 by winding a heater 21 at an outer wall of the spring-type heater 21.

As shown in FIG. 3, for a third type of the tube heating method, there is provided a heating vessel 31 disposed in a middle of a tube 30 and a small heating bottle 32 installed in the heating vessel 31, for thereby heating a gas in a direct contact method, the tube 30 and the heating vessel 31 being connected with a flange 33.

Now, the heating operation of the conventional art will be described.

In the heating operation employing the first type, a fluid heater maintains or heats a temperature of a process source gas with indirect heating through the tube by winding the heater at the tube to supply the heat energy to a fluid substance which flows in the linear tube.

In the heating operation employing the second type, the band heater 21 is provided at the outer wall of the spring-type role tube 20, thereby heating the process gas using the relatively small space. Here, the heating method applied in the second type is an indirect heating method in which the heat energy produced in the band heater 21 is transmitted to the roll tube 20 and then to the process source.

Lastly, the heating operation of the third type employs the heating device of an in-line type, in which the process source is introduced into the heating vessel 31 from the tube 30, so that the process source is heated while passing through the heating bottle 32 and then flows into a reaction furnace through the tube 30.

However, the conventional process source heating methods using the tube have problems.

The method of indirectly heating the process source flowing in the tube such as in the first or second type has a problem in that since the process source is heated through the tube which is a heat transmitting medium, temperature gradient of the process source can be incurred and uniformity of the temperature of the process source is poorly achieved. Also, there is another problem in which the maximum heating temperature is limited at about 300° C. Thus, it is required to develop a hardware apparatus which uniformly controls the temperature of the gas, improves heat efficiency of the heater, and increases the maximum heating temperature.

Also, when applying the tube heating method of the third type, it is possible to solve the problem in which the maximum heating temperature is low in the first and second types due to the indirect heating method. However, the temperature uniformity is poorly achieved because of temperature difference the process source which flows contacting the heating bottle in the heating vessel and the process source which flows at a wall side of the heating vessel without directly contacting the heating bottle.

SUMMARY OF THE INVENTION

Accordingly, the present invention is directed to a fluid heater for a semiconductor device which obviates the problems and disadvantages in the conventional art.

An object of the present invention is to provide a fluid heater for a semiconductor device that prevents a process source from previously reacting or liquefying before being introduced into a reaction furnace and obtains temperature uniformity of the process source so that fluid reaction rapidly and uniformly occurs on a wafer in the reaction furnace, and accordingly semiconductor devices fabricated in the reaction furnace have improved reliability and yield.

To achieve these and other advantages and in accordance with the purpose of the present invention, as embodied and broadly described herein, there is provided a fluid heater for a semiconductor device which heats subsidiary gases to a fluid state to heat a gas for a semiconductor device which increases a temperature of a process source by maintaining a temperature of a process source which is a main gas at about 100° C. using a heating device which has the same configuration as in the conventional art and heating a carry gas or other subsidiary gases at least at a temperature of 600° C., thereby mixing the process source with the heated carry gas or other subsidiary gases in a vaporizer for vaporizing the process source in a liquid state, for thereby increasing the temperature of the process source.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Reference will now be made in detail to the preferred embodiments of the present invention, examples of which are illustrated in the accompanying drawings.

If process sources are excessively heated, the process sources may be reacted before arriving at a reaction furnace. Accordingly, in the present invention, there is applied a method of heating subsidiary gases such as a carry gas or an oxide gas at a temperature of about 600° C. or above and mixing the heated subsidiary gases with process sources at a temperature of 100° C. or below in a vaporizer (not shown), instead of heating the process sources a high temperature and introducing the gas into the reaction furnace. Thus, since there is required a method of heating the subsidiary gases over 600° C., according to the present invention provides a gas heating device for a semiconductor device which heats the subsidiary gases to a fluid state. Here, the carry gas is transmitted to a reaction unit in which the carry gas is mixed with the process sources and thereby reacts before flowing into the reaction furnace, the carry gas preventing the process sources from pre-reacting before arriving at a wafer.

The gas heating device for the semiconductor device according to the present invention will be described with respect to the accompanying drawings. Since the subsidiary gases such as the carry gas maintain a fluid state and also remain in the fluid state before flowing into the reaction furnace, the gas heating device for the semiconductor device according to the present invention means a device for heating a fluid-state gas before it becomes a gaseous state, that is a fluid heater. Accordingly, the fluid heater will be referred as the gas heating device according to the present invention.

Figure 4:
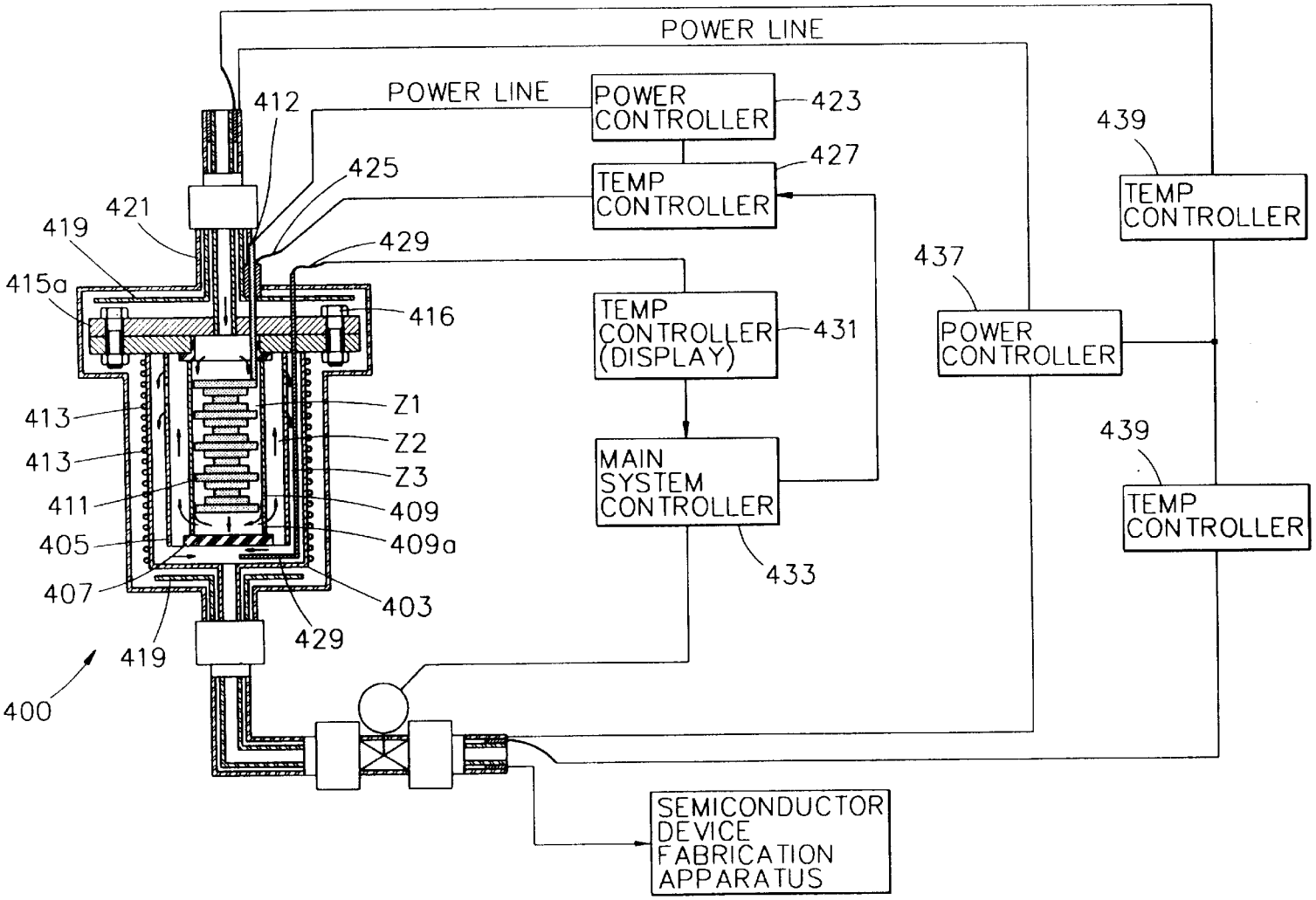
FIG. 4 is a schematic diagram of a gas heating device according to a first embodiment of the present invention.

FIG. 4 is a schematic diagram of a gas heating device according to a first embodiment of the present invention.

As shown therein, 401*a* is an inflow tube wherein a fluid flows to a gas heating device 400, and 401*b* is a discharge tube wherein the fluid heated by the gas heating device 400 flows. The fluid (a subsidiary gas) heated in the gas heating device 400 flows into the vaporizer of an apparatus for fabricating a semiconductor device through the discharge tube 401*b* and mixes with a main gas.

The gas heating device 400 for the semiconductor device is disposed between the inflow tube 401*a* and the discharge tube 401*b*. Particularly, an external vessel 403 is disposed in between the tubes 401*a* and 401*b*, and a flange 415*b* is provided on the external vessel 403. Here, the flange 415*b* is detachable from the external vessel 403 for easily cleaning the fluid heater.

While, an internal vessel 405 is disposed in the external vessel, being spaced from a wall and a bottom thereof, a top portion of which is fixed to the flange 415*b*. A support 407 is placed on a bottom of the internal vessel 405 and a transparent tube 409 which is formed of quartz which has high thermal conductivity is disposed on the support 407 in the internal vessel 405.

The support provided on the bottom of the internal vessel 405 is formed of ceramic or quartz, which is refractory and has high thermal conductivity, and supports the transparent tube 409. Thus, the support 407 is heated by radiant heat supplied from a main heater 411 of the transparent tube 409. The heated support 407 transmits heat to the fluid in the external vessel 403. An upper portion of the transparent tube 409 is also fixed to the flange 415*b*. Further, another flange 415*a* is disposed on the flange 415*b*, and the flanges 415*a* and 415*b* are fixed by a screw 416, for thereby preventing the fluid flowed into the external and internal vessels from being discharged. In addition, the flange 415*a* is connected with the inflow tube 401*a*.

Further, the main heater or an internal heater 411 is disposed in the transparent tube 409. The heater 411 is a helical thermal conductor and the radius of the helical thermal conductor varies in sequence, for example, a long radius, followed by a medium radius, and then a small and the its pattern repeating itself (See FIG. 5A and 5B). Thus, since the main heater 411 has various radii, fluid can be evenly heated whether flowing in a center of the heater 411 or at the edge thereof. Also, a vortex, which is generated by the fluid passing through the helices of the main heater 411, enables the fluid to be well mixed and thus no the temperature gradient of the fluid flowing in the transparent tube 409 is incurred, thereby improving the fluid temperature uniformity.

To maintain a temperature of the fluid heated by the main heater 411, an external heater 413 is disposed around the external vessel 403. Further, a heat shield material 421 is provided at an outer side of the external heater 413 to increase the heat efficiency of the external heater 413. Plate heaters 419 are provided between the heat shield material 421 and a bottom of the external vessel 403 and between the heat shield material 421 and the flange 415*b*, respectively, for thereby preventing the heated fluid from being cooled down, and a line heater 435 is provided along the tubes 401*a* and 401*b* to minimize heat loss of the heated fluid.

A main heater terminal 412 is connected with an end of an upper portion of the main heater 411 to supply power to the main heater 411 and connected with a first power controller 423. A thermocouple which is a first temperature detector 425 is disposed next to the main heater terminal 412 and detects a temperature of the main heater 411, the first temperature detector 425 being connected with a first temperature controller 427 which is connected to the first power controller 423. A main system control device, which will be described later, commands the first temperature power controller 427 to increase the temperature of the main heater 411 and accordingly the first temperature power controller 427 computes power volume for increasing the temperature of the main heater within a predetermined range and applies a signal to the first power controller 423, which supplies power to the main heater 411 in accordance with the signal outputted from the first temperature power controller 427, so that the temperature of the main heater 411 increases.

A second temperature detector 429 is provided between the external vessel 403 and the bottom of the internal vessel 405 to detect a temperature of the fluid flowing between the internal vessel 405 and the external vessel 403, that is, the temperature of the fluid heated by the fluid heater before being discharged. The temperature of the fluid detected by the second temperature detector 429 is indicated by a temperature display 431.

The line heater 435 placed out of the tubes 401*a* and 401*b* prevents the fluid, heated by the fluid heater 400, from being cooled down while being introduced into other devices, such as a thin film fabricating device or a thin film etching device, the line heater 435 being connected with the plate heaters 419. Temperatures and on/off states of the line heater 435 and the plate heaters 419 are controlled by a second temperature controller 439 and a second power controller 437.

Further, a high temperature valve 441 which is heatresisting is provided in the discharge tube 401*b* connected to the fluid heater 400 and a close/open condition of the high temperature valve 441 is determined by a signal which is detected by the second temperature detector 429. When the temperature detected by the second temperature detector 429 is over an objective temperature, for example, a temperature at about 600°C., the main system control device 433 transmits a signal to the high temperature valve 441, which opens its valve to discharge the fluid in the fluid heater 400 into a semiconductor device fabricating apparatus. While, when the temperature detected by the second temperature detector 429 is below the objective temperature, the main system control device 433 controls the high temperature valve 441 to close its valve until the fluid is sufficiently heated up to the objective temperature and supplies a command signal to the first temperature controller 427 to increase the temperature of the main heater 411. The first temperature controller 427, which receives the command to increase the temperature of the main heater 411 from the main system control device 433, supplies a signal to the first power controller 423 to increase the power volume applied to the main heater 411. Thus, the first power controller 423 increases the power volume applied to the main heater 411 in accordance with the signal outputted from the first temperature controller 427, and the temperature of the main heater 411 increases in accordance with the increased power volume, the increased temperature being detected by the first temperature detector 429.

With reference to FIGS. 5 through 9, each unit of the fluid heater according to the present invention in FIG. 4 will now be described in detail.

Figure 5A:
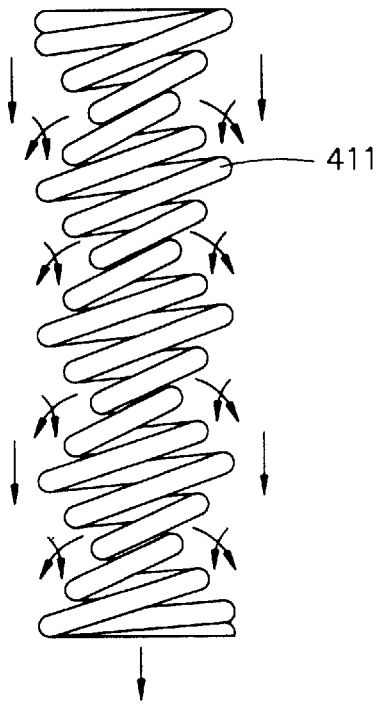
FIGS. 5A and 5B are a side view and a plan view, respectively, of a main heater in FIG. 4.
Figure 5B:
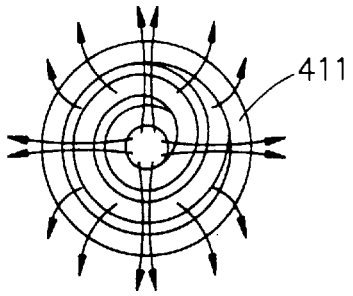

FIGS. 5A and 5B illustrate the main heater 411 of the transparent tube 409. The main heater 411 is formed of the helical conductor having various radii in sequence, for example, a long radius, followed by a medium radius, and then a small and the its pattern repeating itself.

In FIG. 5A, directions of arrows indicate the flow of the fluids. That is, the main heater is helically formed having the different radii, so that the fluids evenly contact the heater and thus are well mixed with each other, which results in improvement of the temperature uniformity of the fluids. Also, since the heater is formed in the helical type, a contact area between the fluid and the heater enlarges, thereby increasing the heat efficiency of the heater. FIG. 5B is a plan view of the FIG. 5A.

Figure 6:
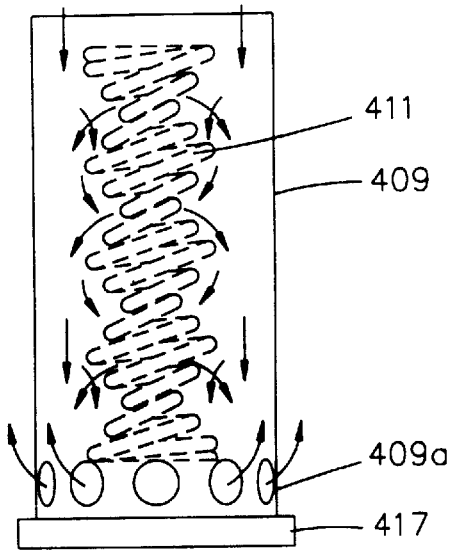
FIG. 6 is a side view of a transparent tube in FIG. 4.

FIG. 6 illustrate the transparent tube 409, the main heater 411 and the support 407. As shown therein, transparent tube holes 409*a* are formed at an lower portion of the transparent tube 409, so that the fluid heated by the main heater 411 is discharged out of the transparent tube 409 through the transparent tube holes 409*a* as in the directions of arrows, which indicate the flow direction of the fluid.

Figure 7:
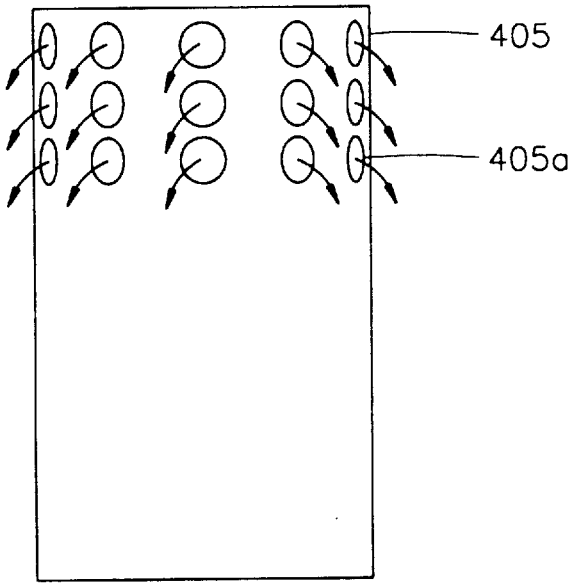
FIG. 7 is a side view of an internal vessel in FIG. 4.

FIG. 7 is a side view of the internal vessel 405. As shown therein, there are internal vessel holes 405*a* formed at an upper portion of the internal vessel 405, so that the fluid is discharged out of the internal vessel 405 through the internal vessel holes 405*a* as in the directions of arrows, which indicate the flow direction of the fluid.

Figure 8A:
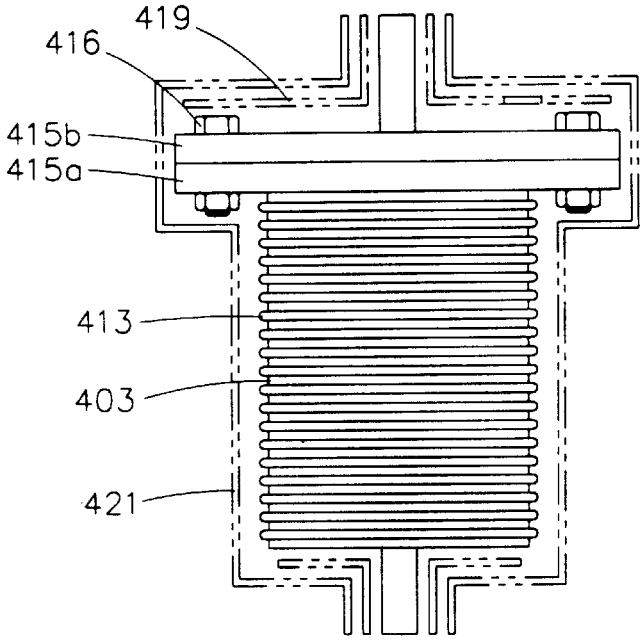
FIG. 8A is an external heater disposed at an outer wall of an external vessel.
Figure 8B:
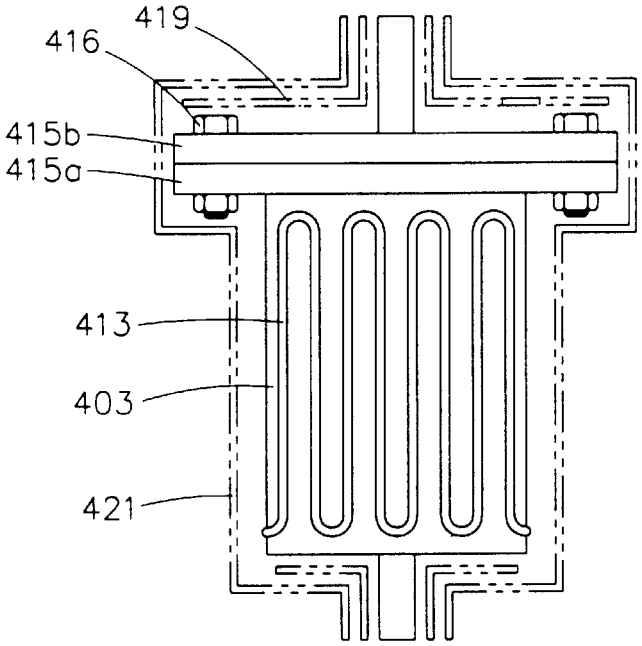
FIG. 8B is another example of an external heater disposed at an outer wall of an external vessel.

FIG. 8A illustrates the external vessel 403 and the is external heater 413 surrounding the external vessel 403 in the horizontal direction, wherein the heat shield material 421 is disposed at the outer side of the external heater 413. In FIG. 8B, the external vessel 403 and the external heater 413 are illustrated, the external heater 413 being vertically disposed at the outer wall of the external vessel 403.

Now, an operation effect of the thusly constructed fluid heater will be explained with the accompanying drawings.

Figure 1:
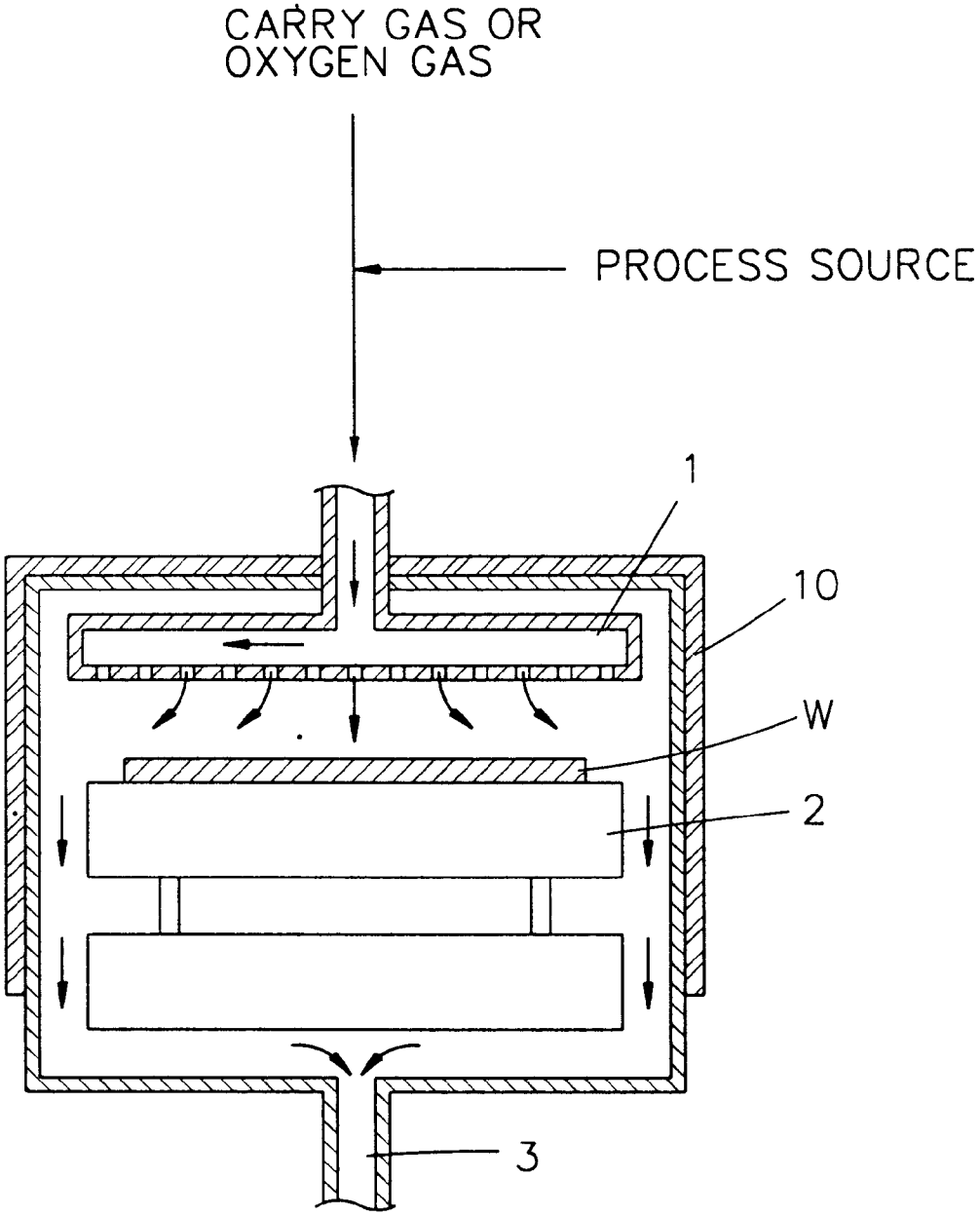
FIG. 1 BACKGROUND ART
FIG. 1 is a schematic cross-sectional vertical view of a reaction furnace for fabricating a semiconductor device.

The gases in the fluid state flow into the transparent tube 409 of the fluid heater 400 according to the present invention through the inflow tube 401*a*, and the fluid introduced into the transparent tube 409 contacts the main heater 411 in the transparent tube 409, thus being initially heated. Here, the fluid in the transparent tube 409 flows from an upper part to a lower part thereof, thus being heated by receiving the heat from the main heater 411. More specifically, the fluid, heated by the vortex which is formed while the fluid passes through the gap of the heater, mixes well, thus being evenly heated. As shown in FIG. 1, the inside of the transparent tube 409 is a first zone Z1. The fluid heated in the first zone Z1 is discharged to a second zone Z2 through the transparent tube holes 409*a* of the lower portion of the transparent tube 409. Here, the second zone Z2 indicates the space between the internal vessel 405 and the transparent tube 409, as also shown in FIG. 1. The fluid flowing into the second zone Z2 is heated by the transparent tube 409, which is secondly heated by the radiant heat supplied from the main heater 411, and then by the support 407 formed of the high temperature conductor. The temperature of the heated fluid is stably maintained and transmitted through the internal vessel holes 405*a* to a third zone Z3, that is, the area between the external vessel 403 and the internal vessel 405. In the third zone Z3, the fluid is heated by the external heater 413 which is in a vertical or horizontal type and located out of the external vessel 403. The fluid heated by the external heater 413 mixes with the process source in the vaporizer.

Figure 2A:
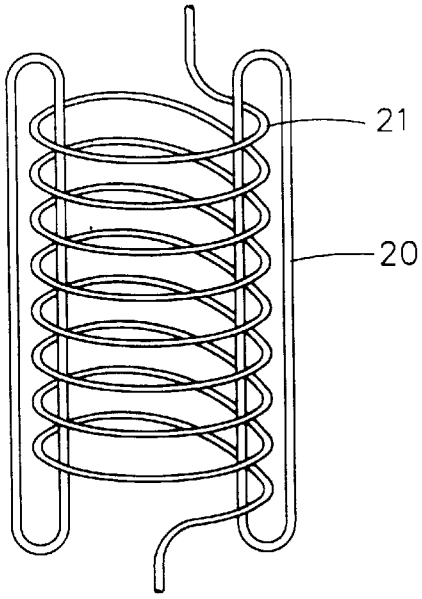
FIG. 2A BACKGROUND ART
FIGS. 2A and 2B are a side view and a plan view, respectively, of a conventional gas heating device for a semiconductor device.
Figure 2B:
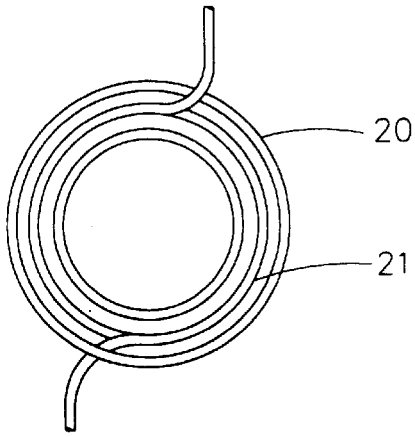
FIG. 2B BACKGROUND ART
Figure 3:
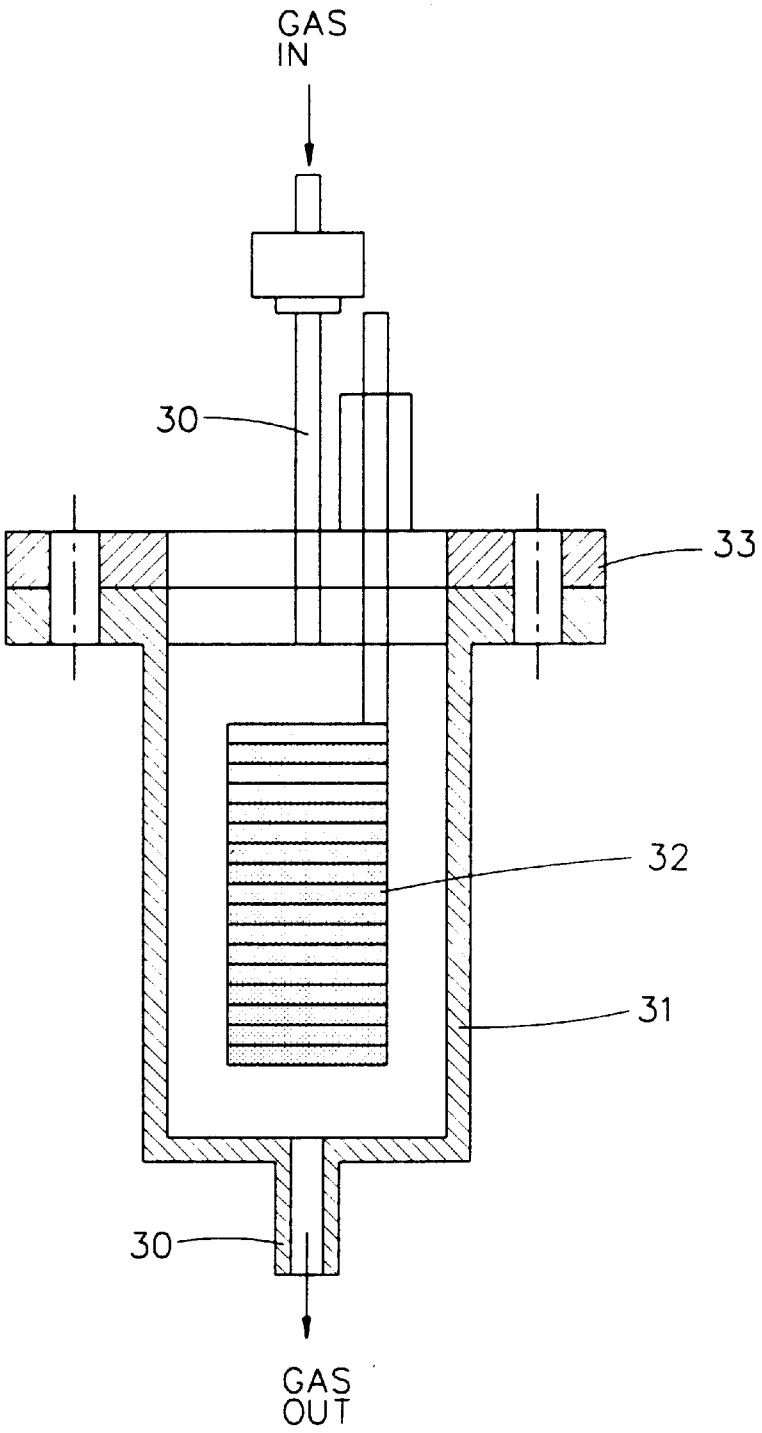
FIG. 3 BACKGROUND ART
FIG. 3 is a schematic cross-sectional vertical view of a another conventional gas heating device for a semiconductor device.
Figure 9:
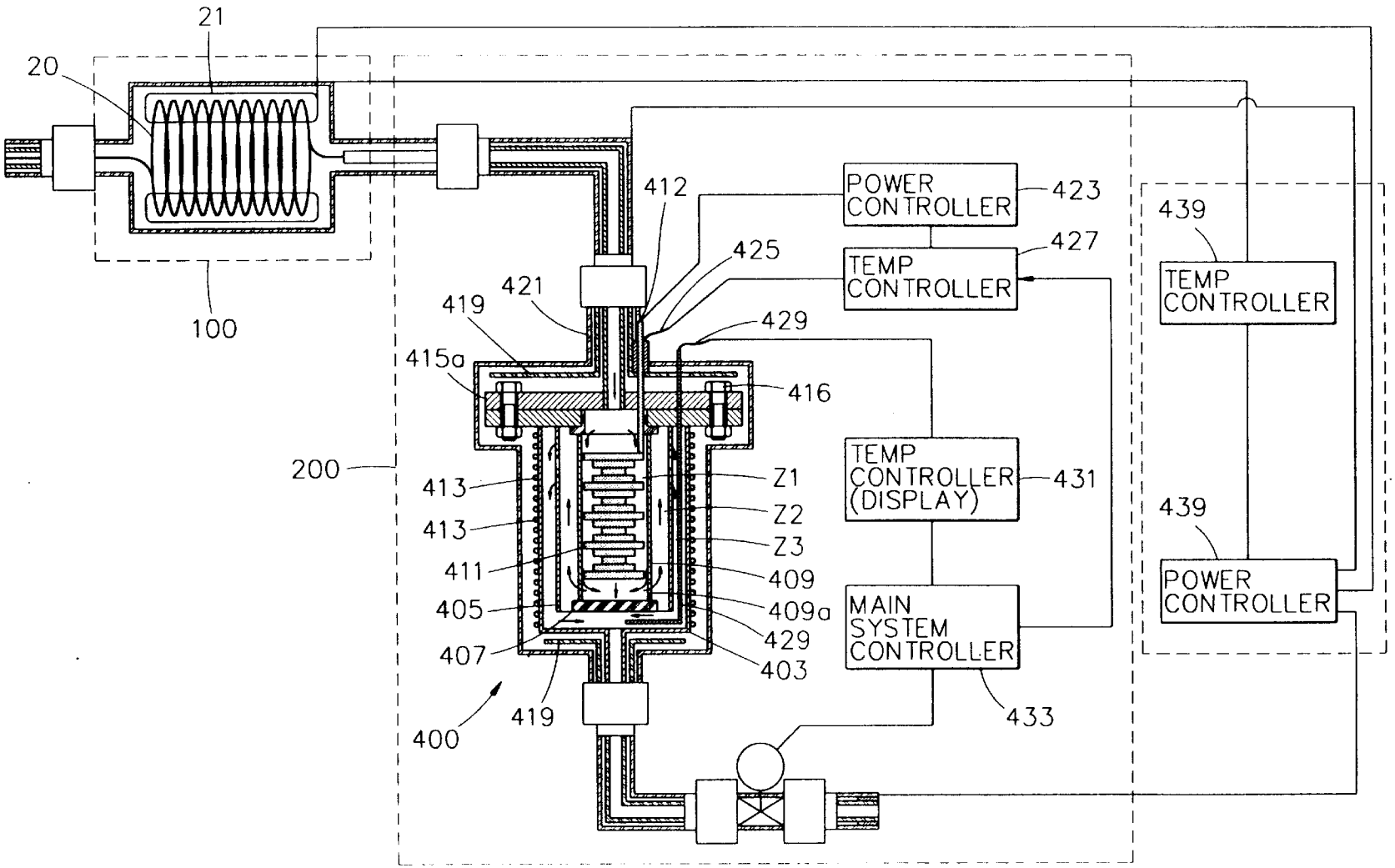
FIG. 9 is a schematic diagram of a fluid heater according to a second embodiment of the present invention.

FIG. 9 is a schematic diagram of a fluid heater according to a second embodiment of the present invention. As shown therein, a helical roll tube 20, described in FIGS. 2*a* and 2*b*, and a band heater 21 are disposed at a front end portion of the inflow tube 401*a* of the fluid heater 400, which has been described in the FIG. 4, the band heater 21 surrounding the outer wall of the roll tube 30. Here, a heating unit consisting of the roll tube 20 and the heater 21 is called a first heating unit 100, and a heating unit of the fluid heater 400 shown in FIG. 4 is a second heating unit 200. Accordingly, in the second embodiment of the present invention, the description of the second heating unit 200 will be omitted since the fluid heater 400 of FIG. 4 can be referred.

In the thusly constructed fluid heater according to the second embodiment of the present invention, gases pass through the first heating unit 100 along the tube. In the first heating unit 100, the gases are indirectly heated by a convection current heated by the externally disposed heater and then flow into the second heating unit 200. The second heating unit 200 can heat the gases at a sufficiently high temperature by direct heating of the main heater in the heating vessel disposed between the tubes, convection current heating, and heat radiance heating, and well mix the fluid by the vortex formation in the main heater, thereby obtaining the temperature uniformity. That is, in the second embodiment of the present invention, the first heating unit is additionally disposed in the front end of the second heating unit for thereby pre-heating the fluid-state gases, so that the fluid can be heated up to the objective temperature within a short period. Also, since the fluid heater according to the second embodiment of the present invention heats the pre-heated fluid, the load of the heater is small, comparing to where the second heating device is only provided.

As described above, the fluid heater according to the present invention heats the process source by heating the subsidiary gases such as the carry gases and mixing the subsidiary gas and the process gas, thereby improving the vaporization efficiency of the process source by preventing previous reaction and liquefaction of the process source.

Also, by employing the in-line type heater in which the helical main heater is provided, the uniformity of the fluid temperature is improved, thereby obtaining a thin film of a high quality, which results in the improvement of the reliability of the semiconductor device. In addition, since the internal vessel and the transparent tube are disposed in the external vessel, the fluid, which is previously heated by the direct contact with the main heater, is once more heated by indirect heating through the tube wall and the support, thereby improving the heat efficiency of the main heater and quickly increasing the fluid temperature.

Further, the fluid heater according to the present invention is designed such that the fluid flows from the top to the bottom of the transparent tube, then from the bottom to the top of the internal vessel, and then from the top to the bottom of the external vessel, thus the flow path of the fluid lengthens even in the small space, comparing to the conventional art, thereby having an effect of efficiently heating the semiconductor gas.

Lastly, since the fluid is heated by the first and second heating units, there is no need to excessively supply the power to either heaters. That is, since the fluid can be sufficiently heated up to the objective temperature with small volume of the power, the load to the heater can be reduced.

It will be apparent to those skilled in the art that various modifications and variations can be made in the fluid heater for the semiconductor device of the present invention without departing from the spirit or scope of the invention. Thus, it is intended that the present invention cover the modifications and variations of this invention provided they come within the scope of the appended claims and their equivalents.

What is claimed is:

1. A fluid heater for a semiconductor device, comprising:

an external vessel (401), a bottom of which is connected with a discharge tube (406) of a fluid or a gas;

a high temperature valve (441) provided in a predetermined portion of the discharge tube **(401*b*)**;

an internal vessel (405) disposed being distanced from an inner wall and the bottom of the external vessel (403) to have a space where the fluid flows in the external vessel (403), the internal vessel (405) having a plurality of internal vessel holes **(405*a*)** at an upper portion thereof;

a transparent tube (409) disposed being distanced from an inner wall of the internal vessel (405) to have a space where the fluid flows in the internal vessel (405), the transparent tube (409) having a plurality of transparent tube holes **(409*a*)** at a lower portion thereof;

a detachable flange (415), one side of which is in contact with the external vessel (403), the internal vessel (405) and the transparent tube (409);

a fluid inflow tube **(401*a*)connected with the other side of the flange (415)**;

a main heater (411) provided in the transparent tube (409) and formed of a thermal conductor in a helical type the radius of which varies; and an external heater (413) disposed at an outer wall of the external vessel (403).

2. The fluid heater according to claim 1, wherein a heat shield material (421) surrounds the external vessel (403) in whole and the transparent tube (409).

3. The fluid heater according to claim 2, wherein a plate heater (419) is disposed between the heat shield material (421) and an upper surface of the flange (415).

4. The fluid heater according to claim 2, wherein a line heater (435) is disposed between the heat shield material (421) and the transparent tube (409).

5. The fluid heater according to claim 1, wherein a support (407) which is refractory and has high thermal conductivity is placed between a bottom of the internal vessel (405) and a lower portion of the transparent tube (409).

6. The fluid heater according to claim 5, wherein the support (407) is formed of ceramic.

7. The fluid heater according to claim 1, wherein the transparent tube (409) is formed of quartz which is transparent and has high thermal conductivity.

8. The fluid heater according to claim 1, wherein the external heater (413) is horizontally disposed at a circumference of the external vessel (403).

9. The fluid heater according to claim 1, wherein the external heater (413) is vertically disposed at a circumference of the external vessel (403).

10. The fluid heater according to claim 1, wherein a first temperature detector (425) for detecting a temperature of the main heater (411) is connected with a main heater terminal (412) which supplies the power to the main heater (411), the first temperature detector (425) being connected with a first temperature controller (427) in which there is provided a first power controller (423) which is connected to the main heater terminal (412), a second temperature detector (429) for detecting a temperature of the fluid before being discharged out of the external vessel (403) is disposed between the bottom of the external vessel (403) and the bottom of the internal vessel (405), a temperature display (431) displaying a temperature of the fluid detected by the second temperature detector (429) is disposed out of the external vessel (403), a main system controller (433) connected with the temperature display (431) commands the high temperature valve (441) to open its valve when the temperature displayed by the temperature display (431) is above an objective temperature and close its valve when the displayed temperature is below the objective temperature and commands the first temperature controller (423) to increase the temperature of the main heater (411).

11. The fluid heater according to claim 1, wherein a helical roll tube (20) is connected with an front end portion of the tube (409) at the fluid inflow side connected to the flange (415) and a band heater (21) surrounds the roll tube (20).

* * * * *